US007751737B2

(12) United States Patent
Ishida et al.

(10) Patent No.: US 7,751,737 B2
(45) Date of Patent: Jul. 6, 2010

(54) IMAGE FORMING APPARATUS WHICH CORRECTS CHARGE POTENTIAL ON AN IMAGE CARRIER

(75) Inventors: Tomohito Ishida, Suntou-gun (JP); Tetsuya Atsumi, Susono (JP); Isami Itoh, Mishima (JP); Masatsugu Toyonori, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 747 days.

(21) Appl. No.: 11/620,149

(22) Filed: Jan. 5, 2007

(65) Prior Publication Data

US 2007/0160376 A1 Jul. 12, 2007

(30) Foreign Application Priority Data

Jan. 12, 2006 (JP) ..... 2006-005153

(51) Int. Cl.
*G03G 15/02* (2006.01)

(52) U.S. Cl. ..... 399/50; 399/51

(58) Field of Classification Search ..... 399/50, 399/51

See application file for complete search history.

(56) References Cited

U.S. PATENT DOCUMENTS

| | | | | |
|---|---|---|---|---|
| 4,265,991 | A | 5/1981 | Hirai et al. | 430/64 |
| 4,451,547 | A | 5/1984 | Hirai et al. | 430/128 |
| 4,507,375 | A | 3/1985 | Hirai et al. | 430/128 |
| 4,552,824 | A | 11/1985 | Hirai et al. | 430/64 |
| 4,659,639 | A | 4/1987 | Mizuno et al. | 430/65 |
| 4,794,413 | A | 12/1988 | Yamazaki et al. | 346/160 |
| 5,481,337 | A | 1/1996 | Tsuchiya et al. | 355/208 |
| 5,576,060 | A | 11/1996 | Hirai et al. | 427/255.2 |
| 5,585,149 | A | 12/1996 | Hirai et al. | 427/578 |
| 5,640,663 | A | 6/1997 | Hirai et al. | 399/350 |
| 5,658,703 | A | 8/1997 | Hirai et al. | 430/95 |
| 5,659,841 | A | 8/1997 | Umeda et al. | |
| 5,756,250 | A | 5/1998 | Hirai et al. | 430/125 |
| 6,006,047 | A | 12/1999 | Mara et al. | |
| 6,466,244 | B2 | 10/2002 | Itoh | 347/132 |
| 6,795,099 | B2 | 9/2004 | Koga et al. | 347/129 |
| 2002/0027591 | A1 | 3/2002 | Itoh | |
| 2003/0156180 | A1 | 8/2003 | Koga et al. | |

FOREIGN PATENT DOCUMENTS

| | | |
|---|---|---|
| EP | 1315365 A2 | 5/2003 |
| JP | 59-136771 | 8/1984 |
| JP | 60-67951 | 4/1985 |

(Continued)

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

An image forming apparatus is provided in which on-surface potential unevenness of an image carrier can be suppressed, and with which an output image having excellent on-surface uniformity of color or the like can be obtained. The image forming apparatus includes: a photoconductive image carrier; charger which charges the image carrier; image exposing unit which exposes an image on a surface of the image carrier after the charging to form a latent electrostatic image; developing unit which develops the latent electrostatic image by adhering toner to the latent electrostatic image to form a toner image; and transfer charger which transfers the obtained toner image to a final supporting member such as plain paper.

8 Claims, 17 Drawing Sheets

FOREIGN PATENT DOCUMENTS

| | | |
|---|---|---|
| JP | 60-35059 | 8/1985 |
| JP | 63-49778 | 3/1988 |
| JP | 63-49779 | 3/1988 |
| JP | 5-165295 | 7/1993 |
| JP | 5-188707 | 7/1993 |
| JP | 5-224483 | 9/1993 |
| JP | 6-3911 | 1/1994 |
| JP | 6-11931 | 1/1994 |
| JP | 6-130767 | 5/1994 |
| JP | 6-266194 | 9/1994 |
| JP | 2000-267363 | 9/2000 |
| JP | 2002-67387 | 3/2002 |
| JP | 2004-223716 | 8/2004 |
| JP | 2004-258482 | 9/2004 |
| RU | 2029329 C1 | 2/1995 |

IMAGE FORMING APPARATUS WHICH CORRECTS CHARGE POTENTIAL ON AN IMAGE CARRIER

BACKGROUND OF THE INVENTION

1. Field of the Invention

The present invention relates to an image forming apparatus in which an image is formed by uniformly charging an image carrier, exposing an image in accordance with inputted image data, and changing a potential on the image carrier. The present invention also relates to a correction method for making the charge potential of the image carrier uniform, and for making the exposure potential of the image carrier uniform when the image is exposed.

2. Description of the Related Art

Heretofore, copying machines, laser beam printers and the like, which employ electrophotography, are known as high-speed, high-quality image forming apparatuses. In recent years, with the advancement of digital technology, a shift from monochrome to color prints and the improvement of qualities of output images have been in rapid progress. Above all, in the field of DTP, there is a strong demand for the color stability and on-surface uniformity of output objects, and various calibration technologies and various technologies for realizing stabilization of electrophotographic processes have been disclosed.

Factors which impair the color stability and on-surface uniformity in an output object, i.e., on the surface of an output image, include, for example, the film thickness unevenness and sensitivity unevenness of an image carrier, the longitudinal unevenness of a charger, the longitudinal unevenness and sleeve revolution unevenness of a developing unit, and various other kinds of unevenness in transfer and fusing. Since these factors occur in combination, various correction technologies have been disclosed. Above all, many correction technologies have been disclosed for unevenness caused by an image carrier, because the pattern of this unevenness is intrinsic to a photoconductor and is therefore relatively stable, and it is difficult to reduce film thickness unevenness and sensitivity unevenness for manufacturing reasons.

Here, unevenness caused by an image carrier will be described from the viewpoints of the constitution and the manufacturing method of the image carrier.

As the image carrier, a function separation type or a single-layer type are used. The function separation type has a two-layer structure including a charge generation layer and a charge transport layer on a conductive supporting base as a lowest layer. With regard to a material constituting the photoconductor, an organic photoconductor (hereinafter referred to as an OPC) made of an organic matter or a photoconductor, which is called an inorganic photoconductor, made of selenium (Se) or silicon (Si) can be used.

In a method of manufacturing an OPC, a solution having a raw material for the OPC dissolved therein is sequentially applied to a base. As the method of manufacturing an OPC, it is possible to use a method such as a spray coating method in which the solution is applied by spraying, and a dipping method in which a base immersed in a solution is extracted to form a film. The thickness of the film in this case and the quality thereof such as the raw material density of the film are adjusted by controlling the viscosity of the solution used to form the film and the extraction speed for dipping. In a case where film characteristics at that time are not uniform, unevenness in the potential on the surface of the photoconductor after charging and unevenness in the exposure potential after exposure occur. Furthermore, in a case where there is unevenness in hardness, charge potential unevenness and exposure potential unevenness occur due to wear unevenness caused by repeating outputs.

As a method of manufacturing an inorganic photoconductor, e.g., an amorphous silicon photoconductor, deposition methods such as vacuum evaporation, sputtering, ion plating, thermal CVD, photo CVD and plasma CVD can be used as described in Japanese Patent Application Publication No. 60-035059 (1985). Among these, plasma CVD in which source gas is decomposed by a direct current, high frequency, or microwave glow discharge to form an a-Si deposit on a supporting base has been put into practical use as a suitable one. In a case where a photoconductor film is formed using such a deposition method, unevenness in film thickness and film quality occurs as in the case of OPCs. Thus, charge potential unevenness and exposure potential unevenness occur on the surface of the photoconductor.

Moreover, as described in Japanese Patent Application Laid-open No. 60-067951 (1985), there is also a photoconductor which achieves improvements such as increasing the strength of a film by superposing a translucent insulating overcoat layer thereto to lengthen the life for the case of repeating outputs. In the case where such improvements are made, charge potential unevenness and exposure potential unevenness on the surface of the photoconductor further increase due to unevenness in the thickness and quality of the added film.

As described above, it is inevitable that an image carrier has unevenness on the surface thereof, and various correction technologies have been contrived. For example, Japanese Patent Application Laid-open Nos. 63-049778 (1988) and 63-049779 (1988) disclose a technology for making the potential (exposure potential) of a laser-exposed portion of a photoconductor uniform along the axial direction thereof by correcting the lighting time of a laser depending on potential characteristics of the exposed portion. This can be achieved by correcting a PWM signal by using a table corresponding to exposure potential characteristics.

Japanese Patent Application Laid-open No. 2000-267363 discloses a technology for correcting exposure by performing exposure with a constant light quantity after charging and then measuring sensitivity unevenness along the direction of movement of a photoconductor by using a potential sensor. In this correction method, correction exposure as an 8-bit laser power value for each pixel is converted into an analog voltage by a digital-to-analog converter, and a voltage value obtained by comparing this voltage and a reference voltage is inputted to the base of a transistor, thereby determining a laser driving current value corresponding to the laser power value. Thus, similar effects can be obtained.

In Japanese Patent Application Laid-open Nos. 5-188707 (1993) and No. 2002-067387, a technology is described in which a latent image region on a photoconductor is divided into two-dimensional segments to perform correction for each segment. In Japanese Patent Application Laid-open Nos. 5-165295 (1993), 5-224483 (1993), 6-003911 (1994), 6-011931 (1994), 6-130767 (1994), 6-266194 (1994) and 2004-258482, described are methods of measuring the sensitivity unevenness of a photoconductor by using a movable potential sensor/density sensor, a plurality of potential sensors/density sensors, or the like. Japanese Patent Application Laid-open No. 2004-223716 discloses a laser control method in which sensitivity unevenness on the entire surface of a photoconductor is corrected.

As described above, many technologies have been disclosed with regard to uniformity in the plane of an image, particularly unevenness on an image carrier. However, in most of the technologies, a single unevenness is corrected. Moreover, even in technologies in which a plurality of kinds of unevenness are corrected, the plurality of kinds of unevenness are corrected together without separating factors of the unevenness, and the current situation is that sufficient correction cannot be realized.

For example, as shown in FIG. 1, there is a case where a charge potential 101 on the surface is flat and does not need to be corrected, and where an exposure potential 102 is uneven and needs to be corrected. In such a case, a flat exposure potential 202 as shown in FIG. 2 can be realized by adjusting the intensity of exposure by multiplying it by a needed correction coefficient for each area on the surface in order that unevenness in the exposure potential can be made flat.

As shown in FIGS. 3 and 4, there is also a case where unevenness in a charge potential 401 and unevenness in an exposure potential 402 occur simultaneously. For example, a characteristic curve (hereinafter referred to as a V-E curve) is referred to in which the integrated exposure (energy) and the surface potential (voltage) at the time are respectively plotted on the horizontal and vertical axes as shown in FIG. 5. For the purpose of making the potentials at A-point and B-point equal to the same potential 501, the desired potential 501 can be obtained at the same pulse width as A-point as shown in the right graph of FIG. 5 by, for example, adjusting the intensity of exposure of a laser. However, charge potential unevenness needs to be corrected separately.

If average correction is targeted, it is also possible to perform correction with the potential unevenness 506 of a halftone region 505 typifying unevenness information. However, in this case, the exposure and charge potentials cannot be corrected with good consistency. In the left graph of FIG. 5, integrated exposure is shown on the horizontal axis in order to show an original V-E curve. In the right graph of FIG. 5, the result of replotting the foregoing by assuming input data is shown.

As shown in FIG. 4, there is a case where unevenness in different characteristics occurs in combination in each area on the surface. In such a case, it is possible to obtain unevenness information for all tones for each area and perform correction for each area. However, this requires not only a huge memory area for storing unevenness information for all tones for each area but also many measurements for obtaining the unevenness information, and therefore leads directly to an increase in cost and a reduction in throughput. Thus, it is a very difficult problem to correct kinds of unevenness, which have different characteristics, simply and with good consistency.

SUMMARY OF THE INVENTION

In the present invention, attention is focused on unevenness on an image carrier, particularly potential unevenness, i.e., charge potential unevenness which occurs in a charging process and exposure potential unevenness which occurs in an image exposure process. Each of these has simple characteristics and can be corrected by a simple method. However, when these kinds of unevenness occur simultaneously in combination, a correction formula drastically becomes complicated.

With attention focused on this, each unevenness is individually detected to store characteristics thereof in separate storage devices. Then, simple correction appropriate to each unevenness is performed thereon. As a result, a consistent and uniform potential distribution is achieved throughout the entire range of tones over the entire image area on the surface.

A first aspect of the present invention is an image forming apparatus including: a photoconductive image carrier; charging means which charges the image carrier; exposing means which exposes an image on a surface of the image carrier after the charging to form a latent electrostatic image; developing means which develops the latent electrostatic image by adhering toner to the latent electrostatic image to form a toner image; and transferring means which transfers the obtained toner image to a final supporting member such as plain paper. The image forming apparatus further includes: measuring means which measures unevenness information on each of a plurality of kinds of on-surface unevenness having different characteristics; and a plurality of storing means which store the information on the plurality of kinds of unevenness. In the image forming apparatus, the exposing means includes a function of modulating a pulse width and a function of modulating power, and the plurality of kinds of on-surface unevenness are simultaneously corrected by controlling emission of light from the exposing means by use of correction values calculated from the information on the plurality of kinds of unevenness.

In a second aspect of the present invention, the plurality of kinds of on-surface unevenness are: charge potential unevenness which occurs when the charging is performed; and exposure potential unevenness which occurs when the exposure is performed and correction is performed on the on-surface unevennesses.

In a third aspect of the present invention, each of the storing means which store the unevenness information stores unevenness information on each position in a matrix formed by two-dimensionally dividing the surface. Based on the information, correction coefficients are determined to perform correction.

In a fourth aspect of the present invention, each of the storing means which store the unevenness information stores one-dimensional direction information along each of a main-scanning direction and a sub-scanning direction on a surface, and unevenness information at each position on the surface is figure out by calculation. Based on the information, correction coefficients are determined to perform correction.

In a fifth aspect of the present invention, potential measurement is used as the measuring means which measures the information on the on-surface unevenness. Based on the information, correction coefficients are determined to perform correction.

In a sixth aspect of the present invention, density measurement after toner adhesion is used as the measuring means which measures the information on the on-surface unevenness. Based on the information, correction coefficients are determined to perform correction.

In a seventh aspect of the present invention, the on-surface unevenness information is measured in the image forming apparatus, and the unevenness information stored in the storing means is regularly updated. Based on the information, correction coefficients are determined to perform correction.

In an eighth aspect of the present invention, amorphous silicon is used for the image carrier.

According to the present invention, on-surface potential unevenness of an image carrier can be suppressed, and an output image having excellent on-surface uniformity of color or the like can be obtained.

Further features of the present invention will become apparent from the following description of exemplary embodiments (with reference to the attached drawings).

DESCRIPTION OF THE EMBODIMENTS

Hereinafter, best modes for carrying out the invention will be described in detail with reference to drawings.

Figure 6:
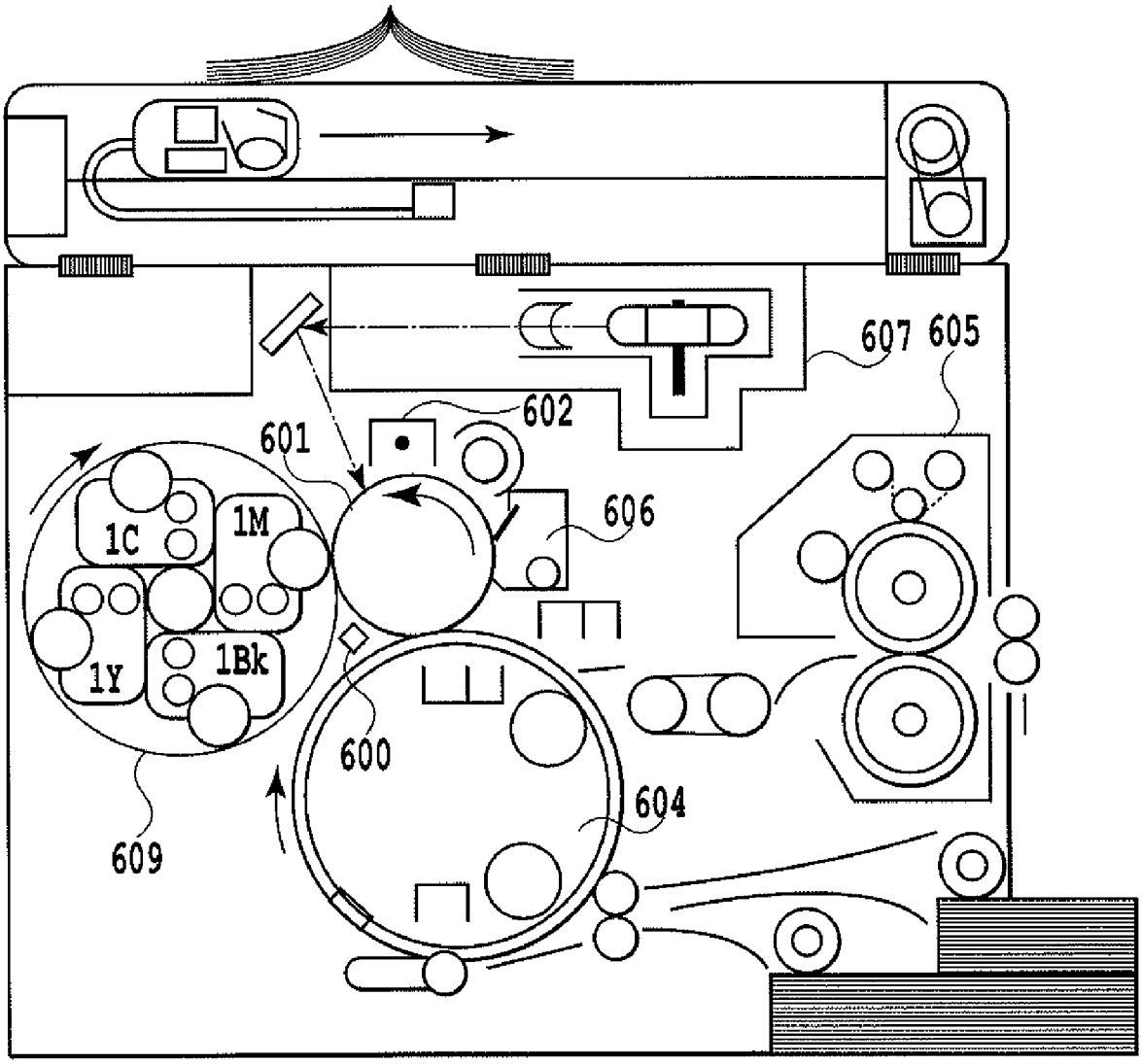
FIG. 6 is a schematic diagram showing a configuration of an image forming apparatus of one embodiment.

FIG. 6 is a schematic diagram showing an image forming apparatus of this embodiment.

The apparatus shown in FIG. 6 is an electrophotographic recording apparatus including a photoconductor drum 601 which is an image carrier, a charger 602 which is charging means, an image exposing unit 607 which is exposing means, a developing unit 609 which is developing means, a transfer charger 604 which is transferring means, a fuser 605, and a cleaning member 606, which are placed around the photoconductor drum 601.

As the photoconductor drum 601, which is an image carrier, a function separation type or a single-layer type can be used. The function separation type has a two-layer structure including a charge generation layer and a charge transport layer on a conductive supporting base as a lowest layer.

The charger 602, which is charging means, can be of a corona charging type in which a corona charger including a wire and an electric field control grid is used, a roller charging type in which a DC bias or a DC/AC superimposed bias is applied to a roller charging device contacting an image carrier thereby to perform charging, an injection charging type in which a magnetic roller carrying magnetic particles or the like is rotated in contact with an image carrier and is biased to inject charges directly into the surface of the photoconductor, thus performing charging, or the like.

The image exposing unit 607, which is an optical system as exposing means, can be a scanner-type one in which a semiconductor laser is used, one in which an image is exposed by an LED through a SELFOC lens as a beam-condensing unit, or other optical system in which an EL element, a plasma light-emitting element or the like is used.

As a developing method, there is a magnetic mono-component non-contact developing method in which magnetic toner is carried by magnetic force, and in which the toner is caused to fly to be developed on an image carrier in a development nip in a non-contact manner. Alternatively, there is also a magnetic contact developing method in which a developing process is performed in a development nip with a developing roller in contact with an image carrier without causing toner to fly. Furthermore, there is a non-magnetic mono-component non-contact developing method in which non-magnetic toner is regulated and charged by a blade and carried on a developing sleeve, and in which the toner is caused to fly to be developed in a development nip in a non-contact manner. Moreover, there is a non-magnetic mono-component contact developing method in which a developing process is performed in a development nip with a developing roller in contact with an image carrier without causing toner to fly. Furthermore, there is a two-component developing method in which non-magnetic toner mixed with a magnetic powder carrier is carried to a developing nip by a developing sleeve to perform developing. As described above, various developing methods can be used.

As a transferring method, a transferring method can be used which utilizes an electric or mechanical force. Methods of performing transfer by utilizing an electric force include: a corona transfer method in which a DC bias having a polarity opposite to the charge polarity of toner is applied using a corona wire to perform transfer; a roller transfer method in which a transfer roller including a member having an electric resistance of 10^5 to 10^12 in the surface layer thereof is brought into contact with an image carrier, and in which a bias having a polarity opposite to that of toner is applied; and the like.

A method of measuring on-surface unevenness according to the present invention will be described in detail.

Available methods of measuring on-surface unevenness of the image carrier include: a method in which after charging, the potential of the image carrier is measured when an image is exposed on the charged image carrier; and a method in which the amount of toner adhering to a latent electrostatic image obtained by exposing an image is measured as a density or the like.

Moreover, in each measuring method, a method can also be used in which the potential unevenness of the image carrier is measured and stored in a storage device such as a ROM in advance before the shipment of the image forming apparatus, thereby to perform correction. Alternatively, other methods can also be used such as one in which after shipment, in the image forming apparatus, the charge potential unevenness and the exposure potential unevenness of an exposed portion are measured to store and update on-surface unevenness information on a rewritable storage device such as a RAM whenever necessary.

An on-surface potential unevenness information storing method of this embodiment will be described in detail.

As a method of storing information on the distribution of potential unevenness, a method can be used in which the image carrier is divided into regions in the form of a two-dimensional matrix, and in which potential unevenness information is stored for each region. Alternatively, the following method can also be used: one-dimensional potential unevenness information is stored for each of the image carrying direction and the longitudinal direction of the image carrier, and the potential unevenness information for one direction is multiplied by that for the other direction to calculate correction values for all the regions. Generally, in a cylindrical image carrier, unevenness is prone to occur in the longitudinal and circumferential directions of the cylinder due to the manufacturing reasons, and there are cases where characteristic estimation can be performed in all regions by multiplying both characteristics.

An exposing mechanism of this embodiment will be described in detail.

In this embodiment, a scanner-type optical system is used as an optical device for exposing an image.

Figure 7:
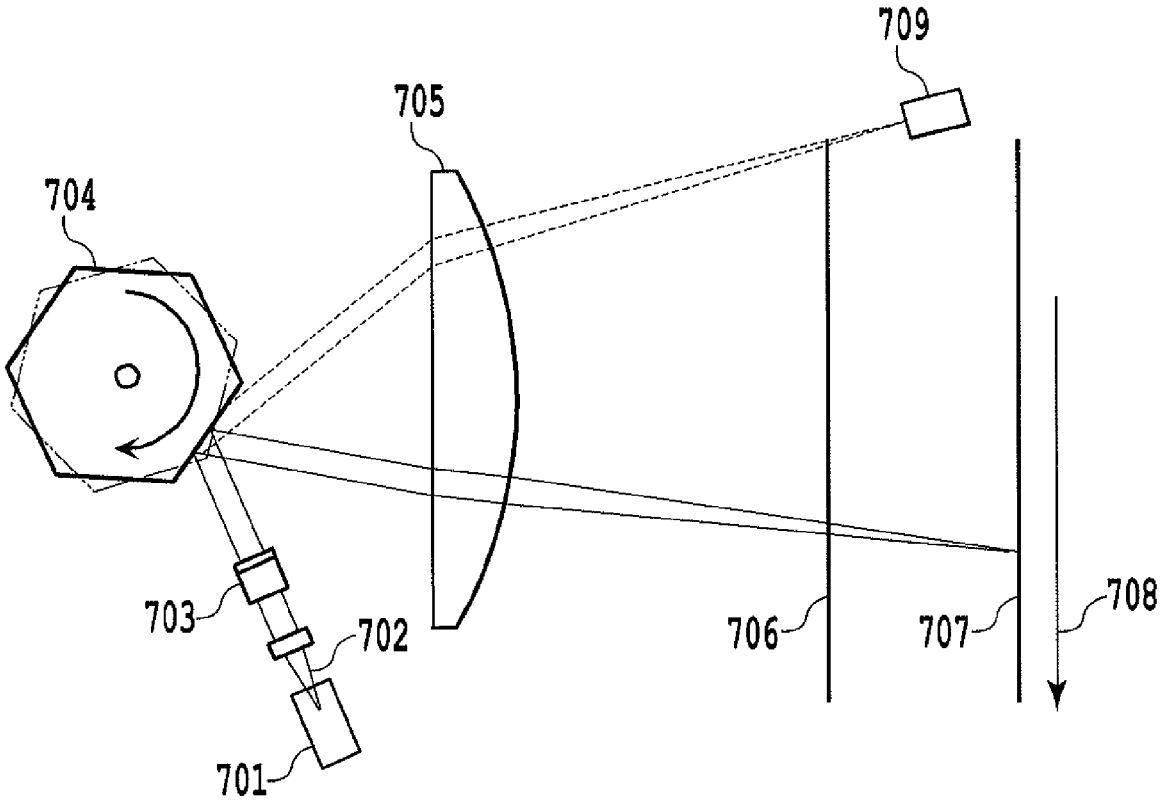
FIG. 7 is a schematic diagram showing a configuration of exposing means of one embodiment.

As shown in FIG. 7, the optical device includes a semiconductor laser unit 701, a polygon mirror 704 which rotates at high speed, a collimator lens 702 which converts a bundle of rays emanating from the semiconductor laser unit 701 into parallel rays, a cylinder lens 703 which focuses the bundle of parallel rays on the polygon mirror surface, and an f-θ lens group 705 for applying the bundle of rays deflected by the polygon mirror 704 to the drum surface at a constant speed.

In the semiconductor laser unit 701, a PD sensor is provided which is a sensor for detecting part of laser light. By performing automatic power control (APC) on the semiconductor laser by using a detection signal of this PD sensor, stable image recording can be achieved in which variations in the laser power due to disturbance such as a temperature rise because of laser emission are suppressed. This semiconductor laser unit 701 receives a time-series digital image signal outputted from a computing unit of an image scanner or a personal computer, and blinks in accordance with an emission signal from a laser driver, which will be described later.

The bundle of rays emanating from the semiconductor laser 701 is reflected and deflected by the surface of the polygon mirror 704 rotating at a constant speed, passed through the f-θ lens group 705, and reflected by a folding mirror 706. Then, an image of the bundle of rays is formed on the photoconductor drum 707 in the shape of a spot, and scanned at a constant speed in a predetermined direction 708. The write start position along the scanning direction at this time is controlled by a detection signal of the PD sensor 709 provided in an end portion of an optical scan region so that the writing of an image signal is always started from the same position.

As a semiconductor laser driving method of this embodiment, a method called pulse width modulation (PWM) control can be used in which the quantity of emitted light is controlled by changing the emission pulse width. Alternatively, various other control methods can be used, such as a method called power modulation (PM) control in which the quantity of emitted light is controlled by changing the laser power, and a method in which the quantity of emitted light is controlled using these in combination.

Figure 8:
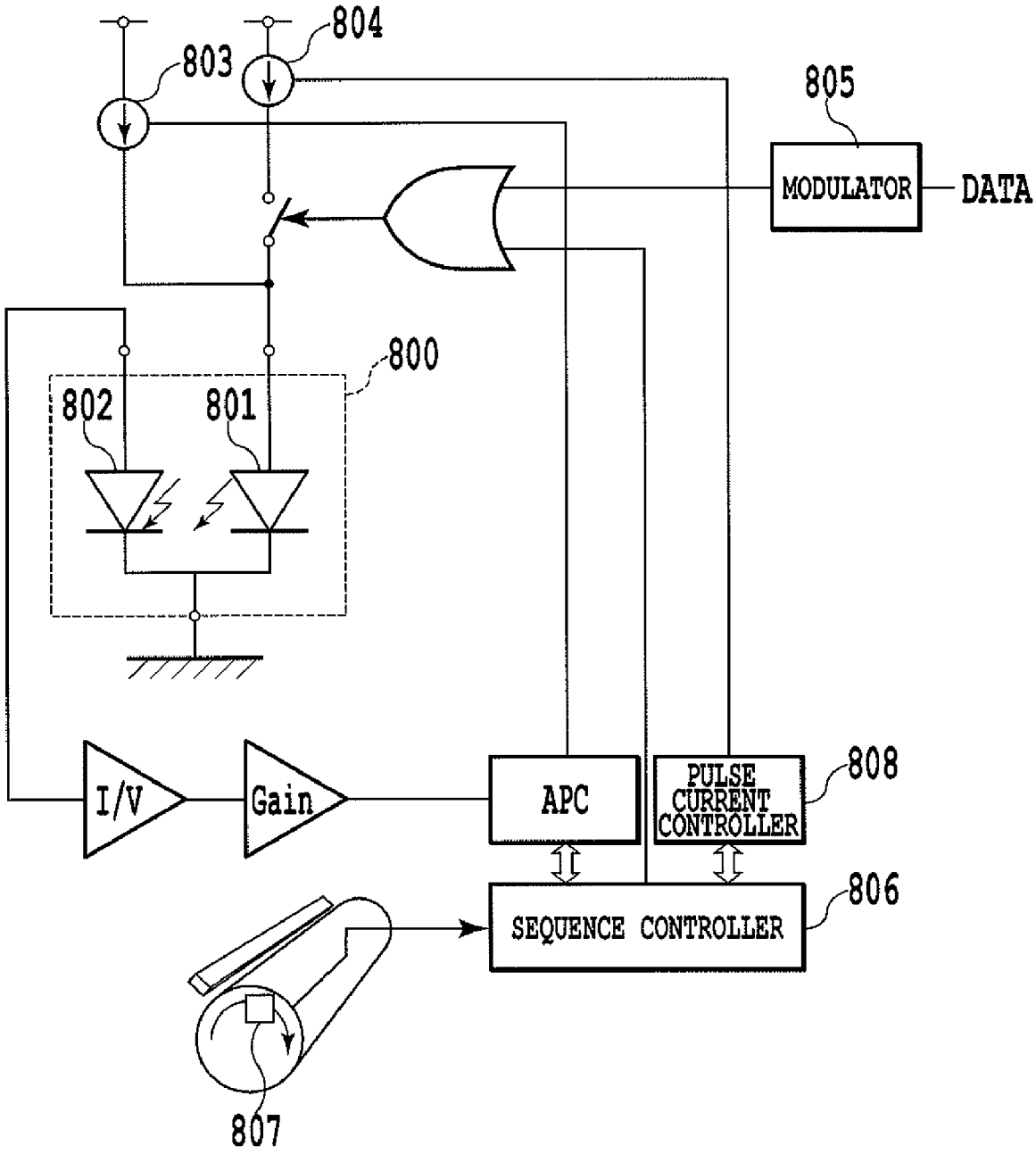
FIG. 8 is a schematic diagram showing a configuration of a laser driving circuit of one embodiment.

In FIG. 8, one example of a laser driver is shown.

In the example shown in FIG. 8, a laser chip 800 is used which includes a laser 801 and a PD sensor 802. In this configuration, two current sources, which are a bias current source 803 and a pulse current source 804, are supplied to the laser chip 800 to improve emission characteristics of the laser 801. Furthermore, in order to stabilize the emission of the laser 801, an output signal from the PD sensor 802 is fed back into the bias current source 803, and the amount of bias current is thus automatically controlled as described previously.

At the time of image drawing, for data inputted to a modulator 805, the write start position of the image along the sub-scanning direction is controlled by a sequence controller 806. On the other hand, the write start position of the image along the main-scanning direction is detected by a Beam Detect sensor (hereinafter referred to as a BD sensor, corresponding to 709 in FIG. 7) to be controlled with a detection signal as a reference (hereinafter referred to as a BD signal). The laser 801 is blinked at desired timing by these controls, thus writing an image.

Figure 9:
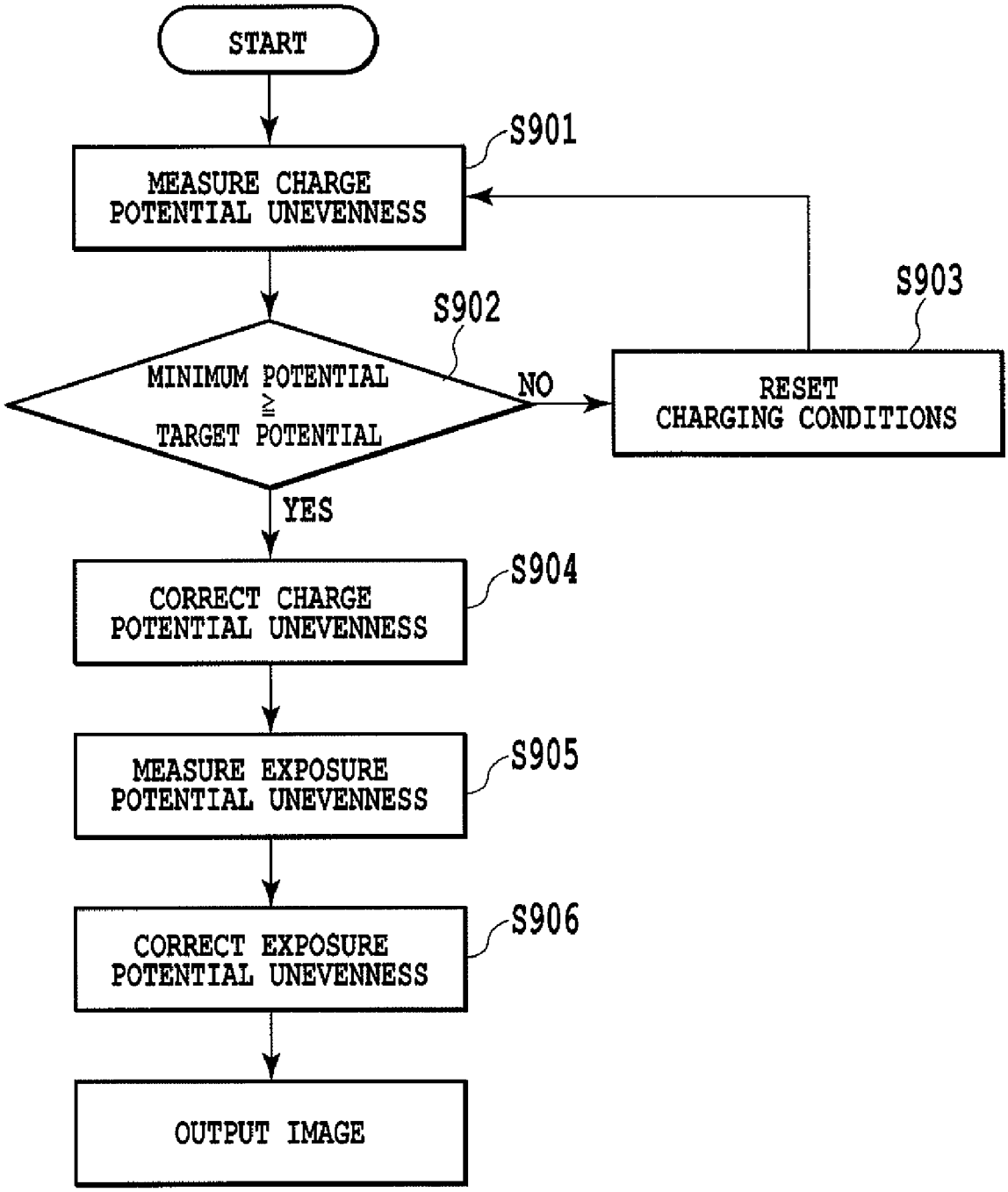
FIG. 9 is a flowchart of a correction method of one embodiment.

In FIG. 9, one example of a processing flow used in the present invention is shown.

With regard to the correction of the charge potential, in a case where correction is performed by photoexposure, correction cannot be performed in the direction in which the charge potential is increased. For this reason, setting the absolute value of the charge potential requires that the minimum value of the charge potential be higher than a target potential. In this regard, when charge potential unevenness is measured, the minimum potential and the target potential are compared (step S902). If the measured minimum potential is lower than the target potential, charging conditions are reset depending on the difference therebetween (step S903), and potential unevenness data on the charge potential is measured again (step S901).

As shown in FIG. 9, this flow is repeated, and, when the minimum value of the charge potential becomes higher than the target potential, the process proceeds to the next flow, which is the correction of charge potential unevenness (step S904). After this correction, the process proceeds to exposure potential unevenness measurement (step S905) and then to exposure potential unevenness correction (step S906).

Hereinafter, Example 1 will be described in detail. A-point and B-point of FIG. 4 indicate two regions having different tendencies in charge potential and exposure potential. Potential characteristics of each region for this case will be described with the integrated light quantity (here, integrated light quantity input data) on the horizontal axis and the surface potential of the image carrier on the vertical axis.

In this example, an image is formed using a scanning optical system 607 (details thereof are shown in FIG. 7) such as shown in FIG. 6 and the developing unit 609 which is rotatable. To measure unevenness information for surface unevenness correction, a potential sensor 600 (details thereof are shown in FIG. 10) is used which is placed along the longitudinal direction of the image carrier.

First, the main power of the image forming apparatus is turned on, and the apparatus enters a potential correction mode to perform process processing involving no image output. The image carrier rotates to be subjected to a charging process by the corona charger 602. The charged portion of the image carrier is not subjected to image exposure and passes in front of the potential sensor 600 in a state where the developing unit 609 is on standby at a position deviated from the position opposite to the image carrier.

Figure 10:
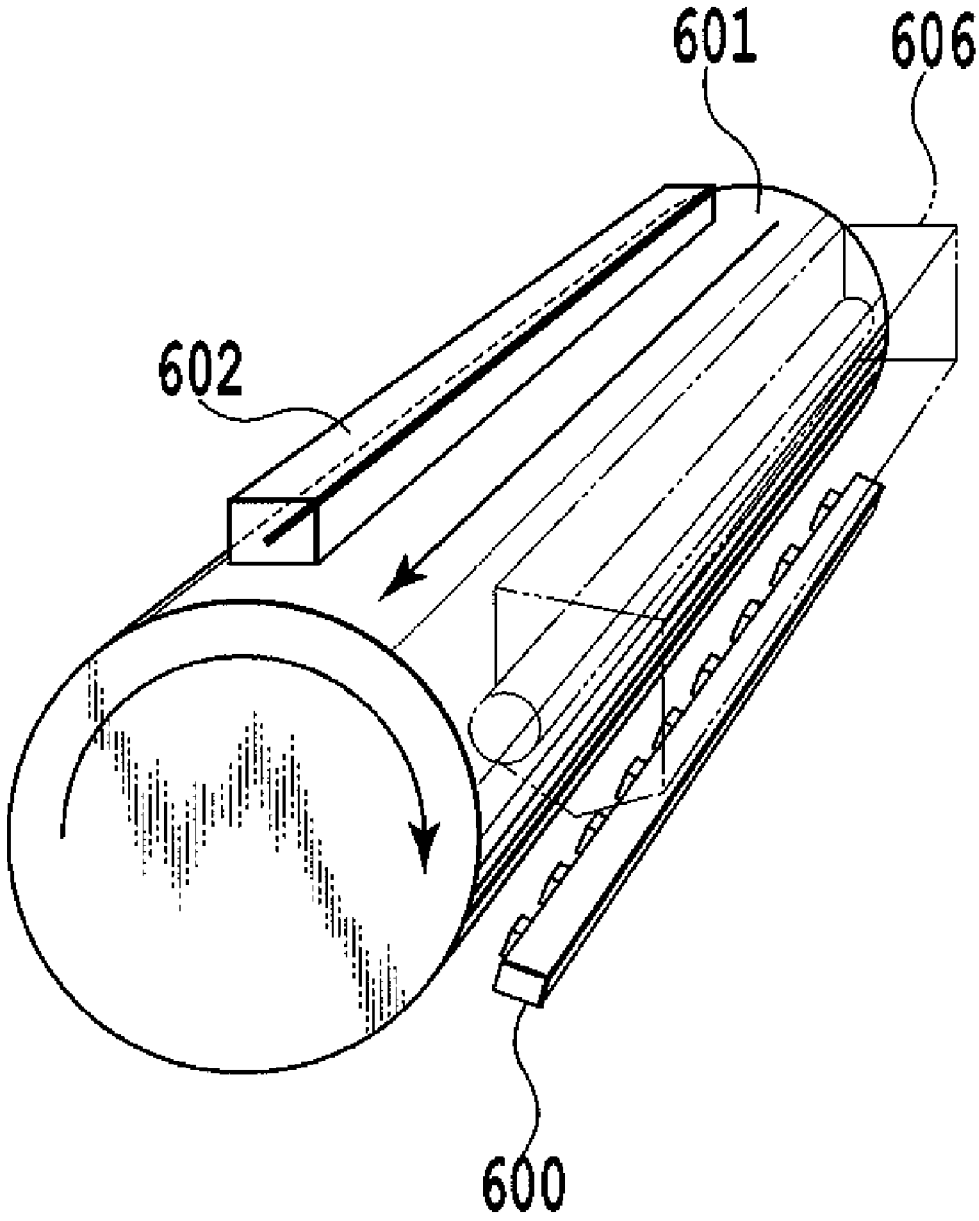
FIG. 10 is a schematic diagram showing a configuration for potential measurement of one embodiment.

As shown in FIG. 10, the potential sensor 600 includes nine potential sensors placed along the longitudinal direction of the image carrier to measure nine points along the longitudinal direction simultaneously. In this example, the potential is measured at each of the nine points along the longitudinal direction at 10 mm intervals along the rotation direction. Furthermore, in this example, the image carrier having a diameter of 80 mm is used. This means that potential data is obtained at 25 points along the circumferential direction, i.e., 225 points in total on the surface along both the main- and sub-scanning directions.

The minimum value is read from the 225-point measured potential data, and compared to the set potential value which is a target. In a case where the measured potential data is smaller than the set target potential value, the grid voltage value of the corona charger 602 is adjusted depending on the difference therebetween, and the charge potential is measured again. This flow is repeated, and in a case where the measured potential data becomes the set target potential value or more, the process proceeds to a charge potential correction flow as shown in FIG. 9. The reason for doing this is that since the charge potential cannot be corrected upward by the correcting function of photoexposure, the setting of the absolute value of the charge potential requires that the minimum value of the charge potential be higher than the target potential.

In the charge unevenness correction flow, measured potential data is stored in a RAM (not illustrated), which is storing means, for each position along the main- and sub-scanning directions. For the main-scanning direction, position information is obtained by counting up image clocks with the BD signal as a reference as described previously. On the other hand, for the sub-scanning direction, which is the rotation direction of the image carrier, position information is obtained as follows: first, the home position (HP) of the image carrier is detected using a detection signal of a reflective sensor 807 placed on a side surface of the rotating image carrier; and then, with this signal as a reference, an address value is counted up every time a BD signal is obtained, thus obtaining position information. The obtained position information for each position and the measured on-surface potential are associated with each other and sequentially stored in the RAM.

Figure 11:
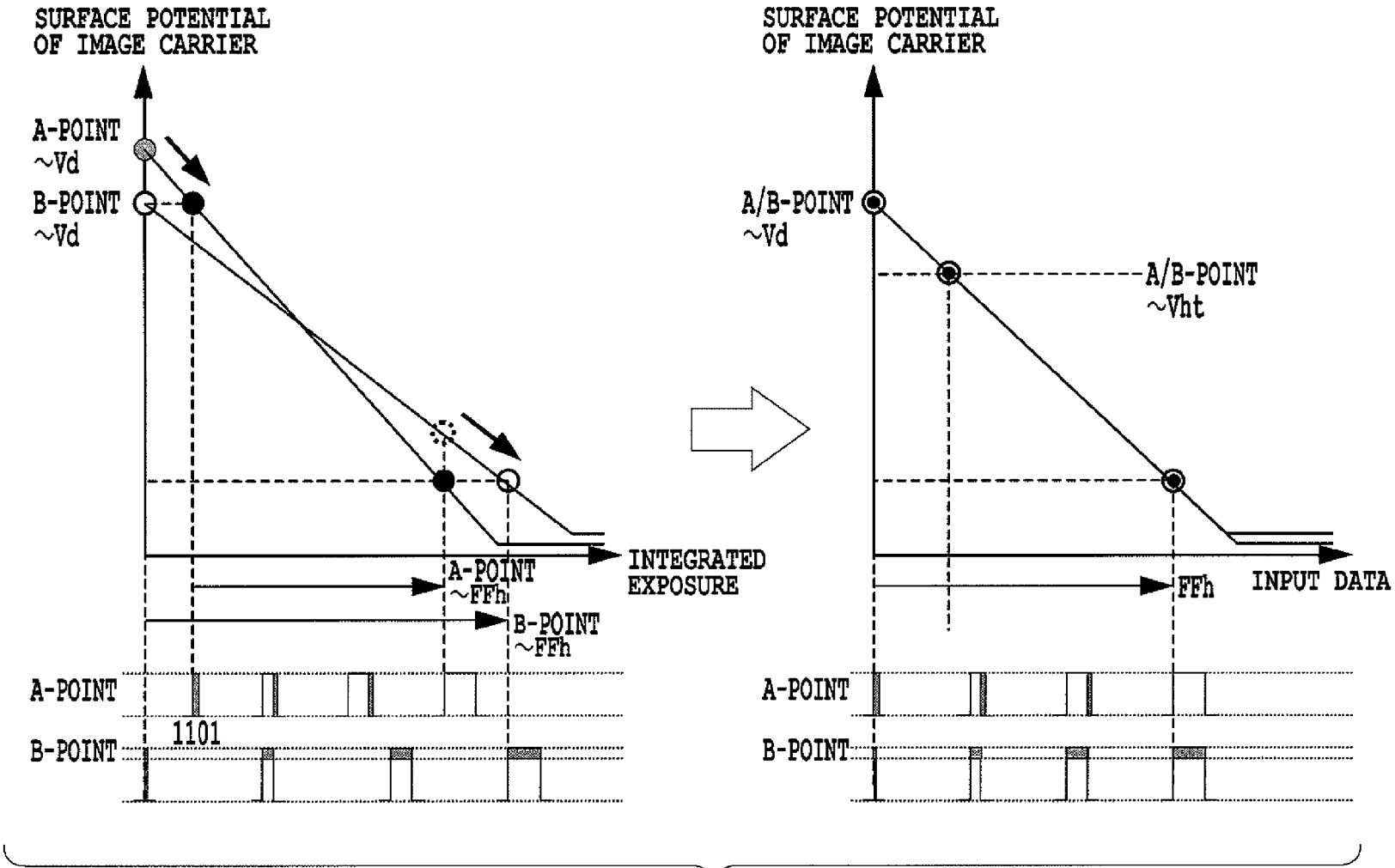
FIG. 11 is graphs for explaining the correction method which is an object of the present invention.

The correction of charge potential unevenness is performed by adjusting the pulse width of a laser pulse at 00h. Specifically, as shown in FIG. 11, in a case where it is assumed that the target potential is the potential at B-point, the target potential can be obtained at A-point by setting the laser pulse width at 1101. Thus, by setting the pulse width at the time of 00h emission at 1101, both the charge potentials at A-point and B-point can be set at the target charge potential when input data is 00h, as shown in the right graph of FIG. 11.

The correction of on-surface unevenness is realized by switching the correction pulse width of the laser of the scanning optical system for every 10 mm along the main-scanning direction. In this example, measurement is performed at nine points with 40 mm pitch along the main-scanning direction of the laser scan, i.e., the longitudinal direction of the image carrier. Accordingly, linear interpolation is performed using these points, and, from the on-surface unevenness data with 10 mm pitch for 33 points, correction coefficients for the laser pulse width are obtained by the above-described method, and stored in a line buffer memory (RAM).

The address of a correction position is determined by the aforementioned method, and a correction value corresponding to the address is inputted from the sequence controller 806 to a pulse current controller 808, thus realizing desired pulse width control for each position. In this example, for the sub-scanning direction, which is the rotation direction of the image carrier, since potential data is stored with 10 mm pitch, correction is performed across a width of ±5 mm along the circumferential direction for each measurement position. On the other hand, for the main-scanning direction, correction coefficients for the main-scanning direction are sequentially calculated from the unevenness information stored in the RAM in accordance with the rotation of the image carrier, thus correcting the laser pulse width.

Figure 12B:
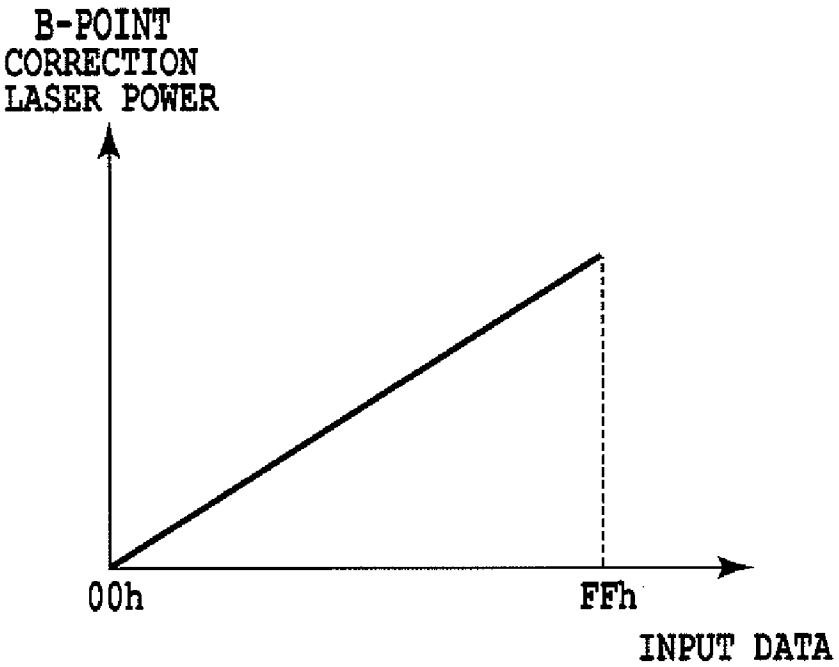
FIG. 12B is graphs for explaining the correction method of one embodiment.
Figure 12A:
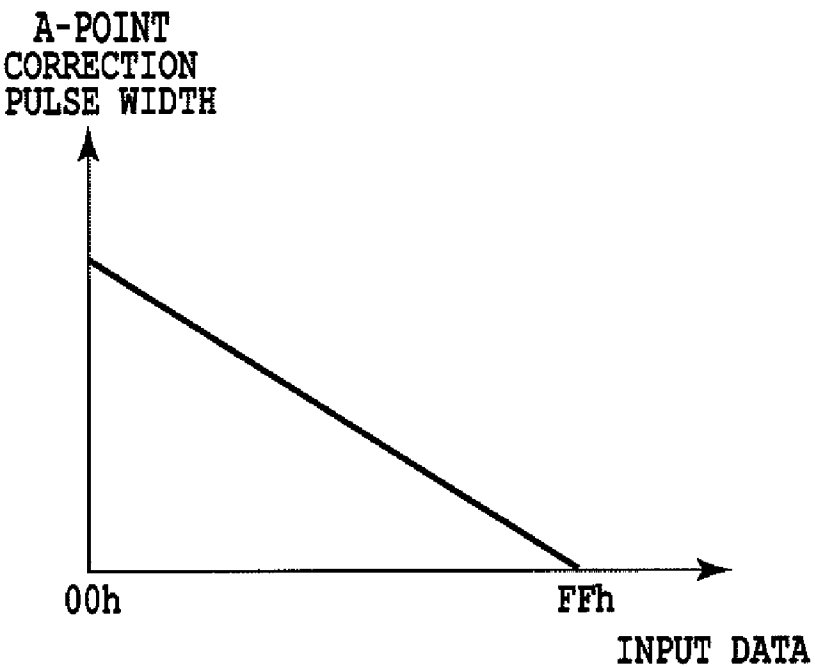
FIG. 12A is graphs for explaining the correction method of one embodiment.

With regard to the change of the correction pulse width used at this time with tone, as shown in FIG. 12A, in a case of 00h in which exposure is not performed, a pulse width corresponding to the difference between the target charge potential and the measured charge potential is applied. Furthermore, by performing linear interpolation so that the correction pulse width becomes zero when input data is FFh, i.e., max, the correction of the pulse width has been realized with good consistency throughout the entire range of tones.

After the charge potential is corrected as described above, the process proceeds to an exposure potential correction flow (S905 to S906 of FIG. 9).

In the correction of the exposure potential, the image carrier rotates to be subjected to a charging process by the corona charger 602, and then an image is exposed with the maximum pulse width for FFh. The exposed portion of the image carrier passes in front of the potential sensor 600 in a state where the developing unit 609 is on standby at a position deviated from the position opposite to the image carrier. As shown in FIG. 10, the potential sensor 600 includes the nine potential sensors placed along the longitudinal direction of the image carrier to measure nine points on the image carrier along the longitudinal direction simultaneously.

In this example, the potential is measured at each of the nine points along the longitudinal direction at 10 mm intervals along the rotation direction. Furthermore, in this example, the image carrier having a diameter of 80 mm was used. This means that potential data is obtained at 25 points along the circumferential direction, i.e., 225 points in total along both the main- and sub-scanning directions. The reason for performing measurement with the maximum pulse width is that potential unevenness was emphasized most strongly in the potential measurement result for the maximum pulse width, and that exposure potential unevenness in a halftone portion and exposure potential unevenness in an FFh portion have the same tendency.

Figure 1:
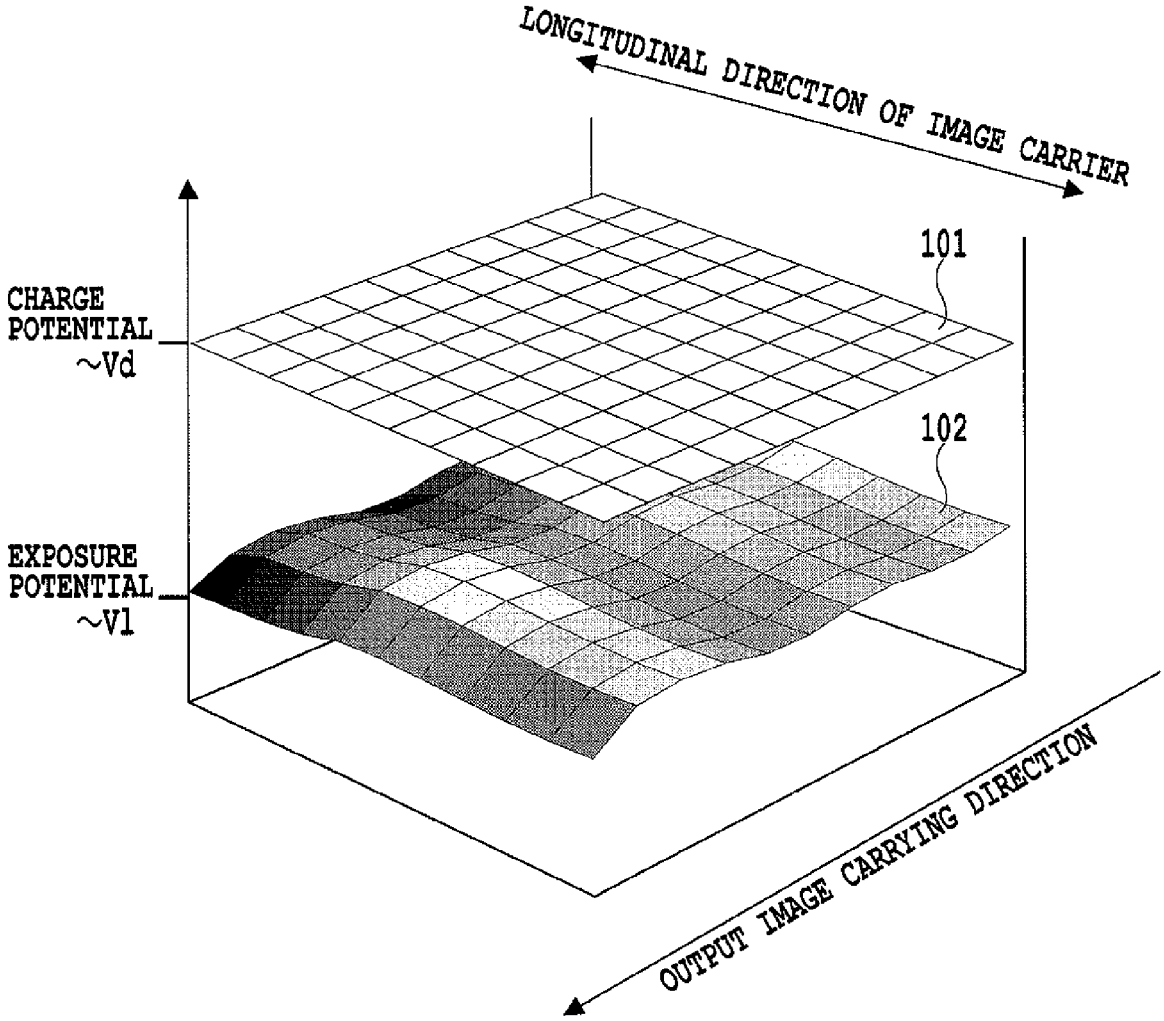
FIG. 1 is a diagram for explaining potential unevenness which is a target of the present invention.
Figure 2:
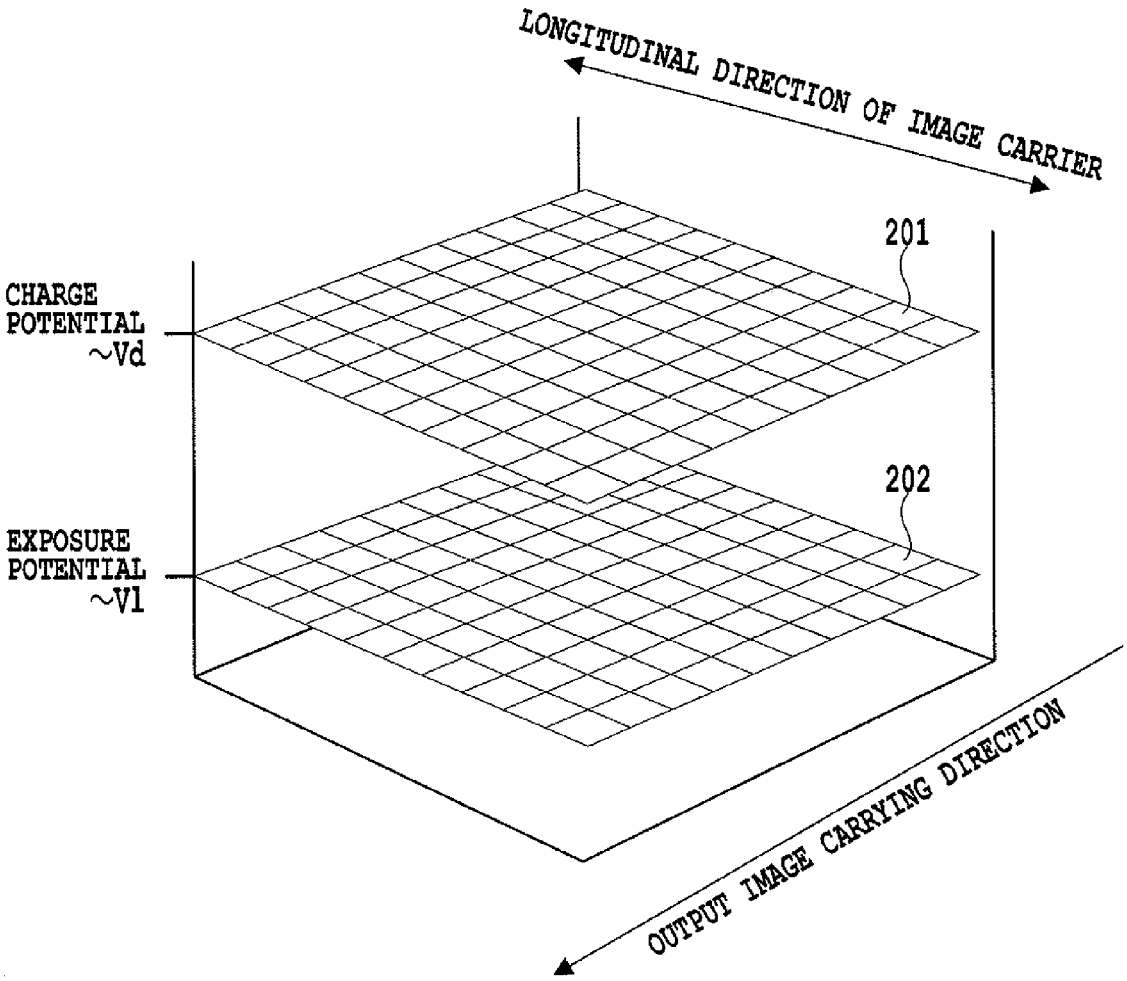
FIG. 2 is a diagram for explaining potential unevenness which is a target of the present invention.
Figure 3:
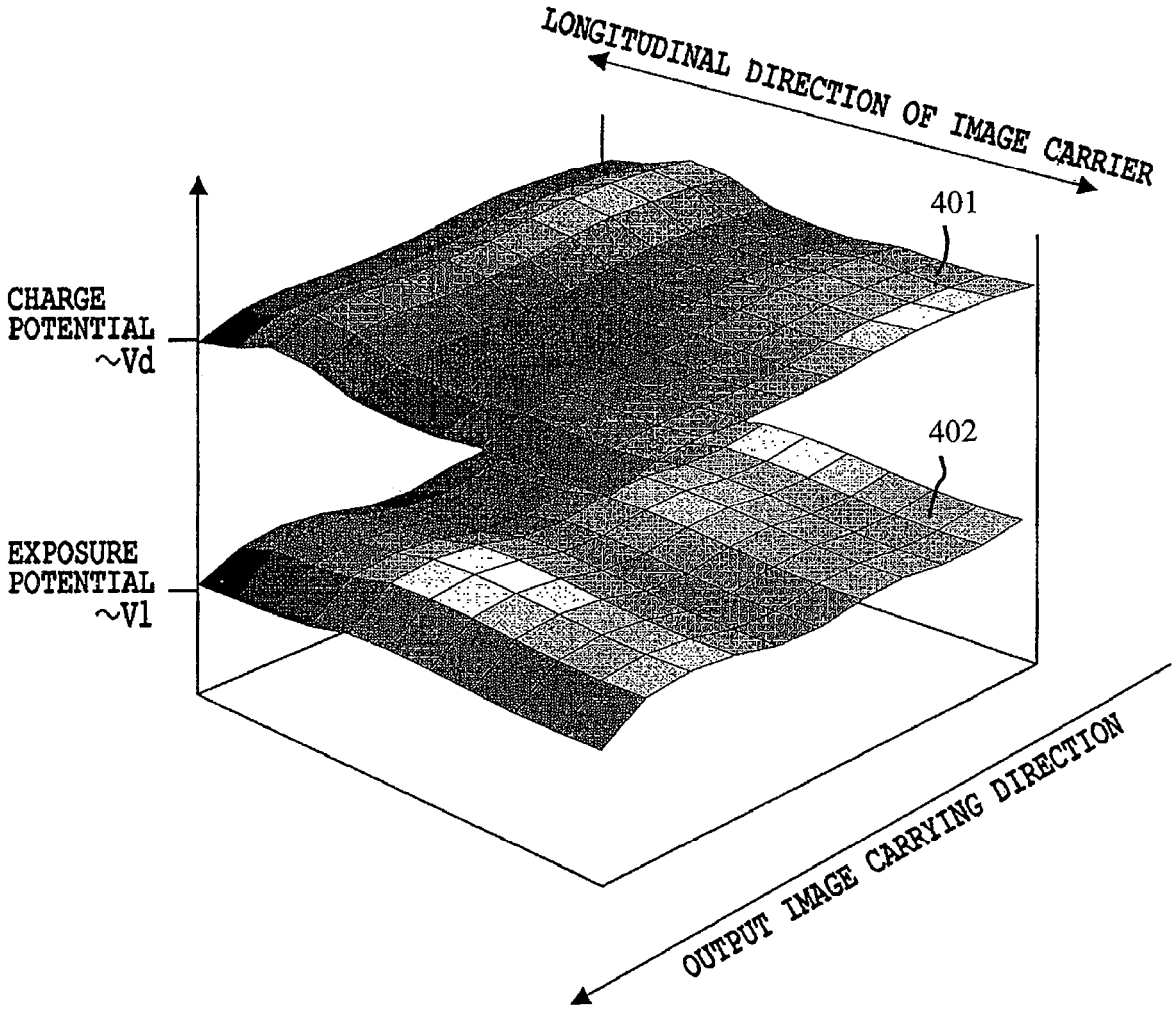
FIG. 3 is a diagram for explaining potential unevenness which is a target of the present invention.
Figure 4:
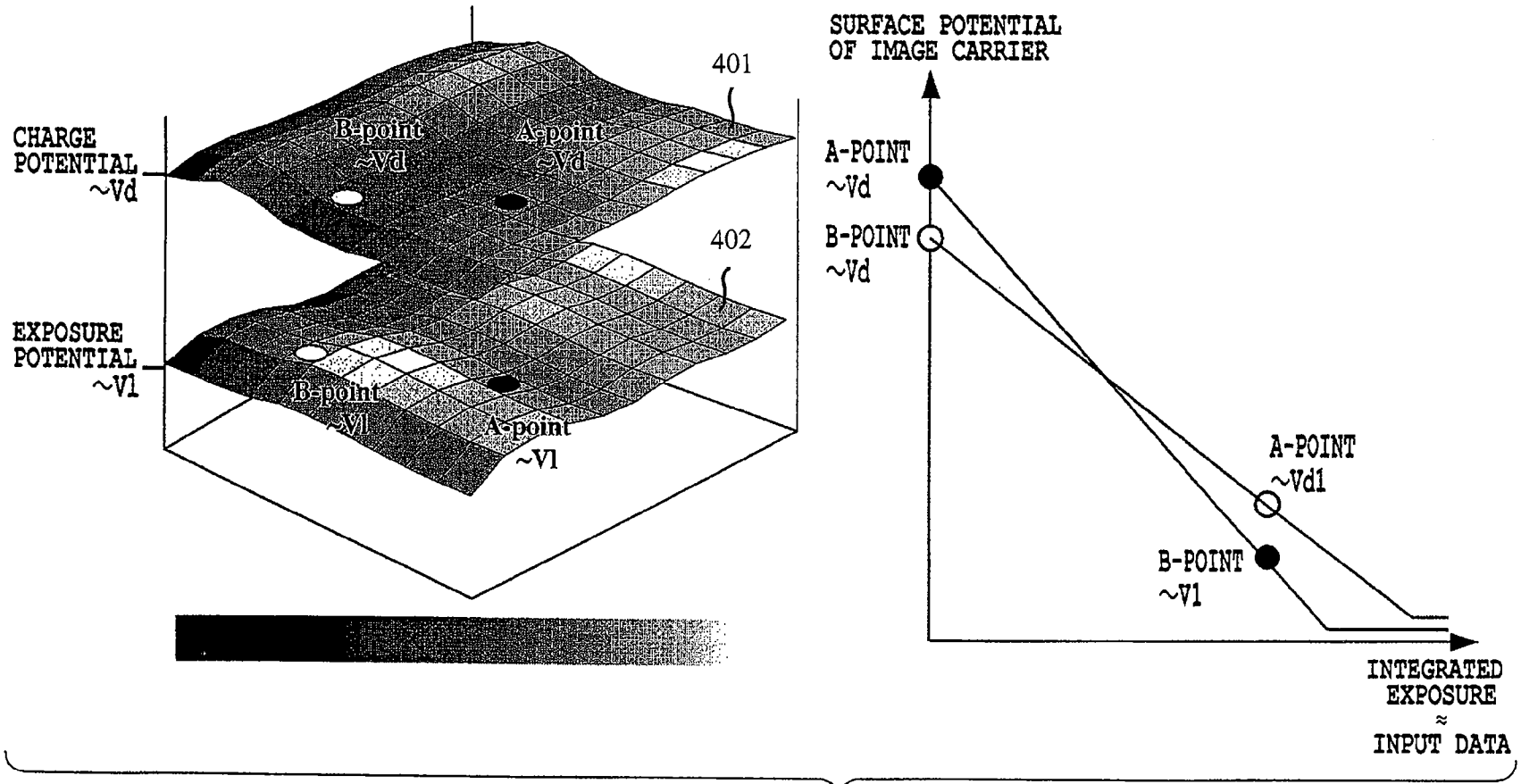
FIG. 4 is a diagram and a graph for explaining potential unevenness which is a target of the present invention.
Figure 5:
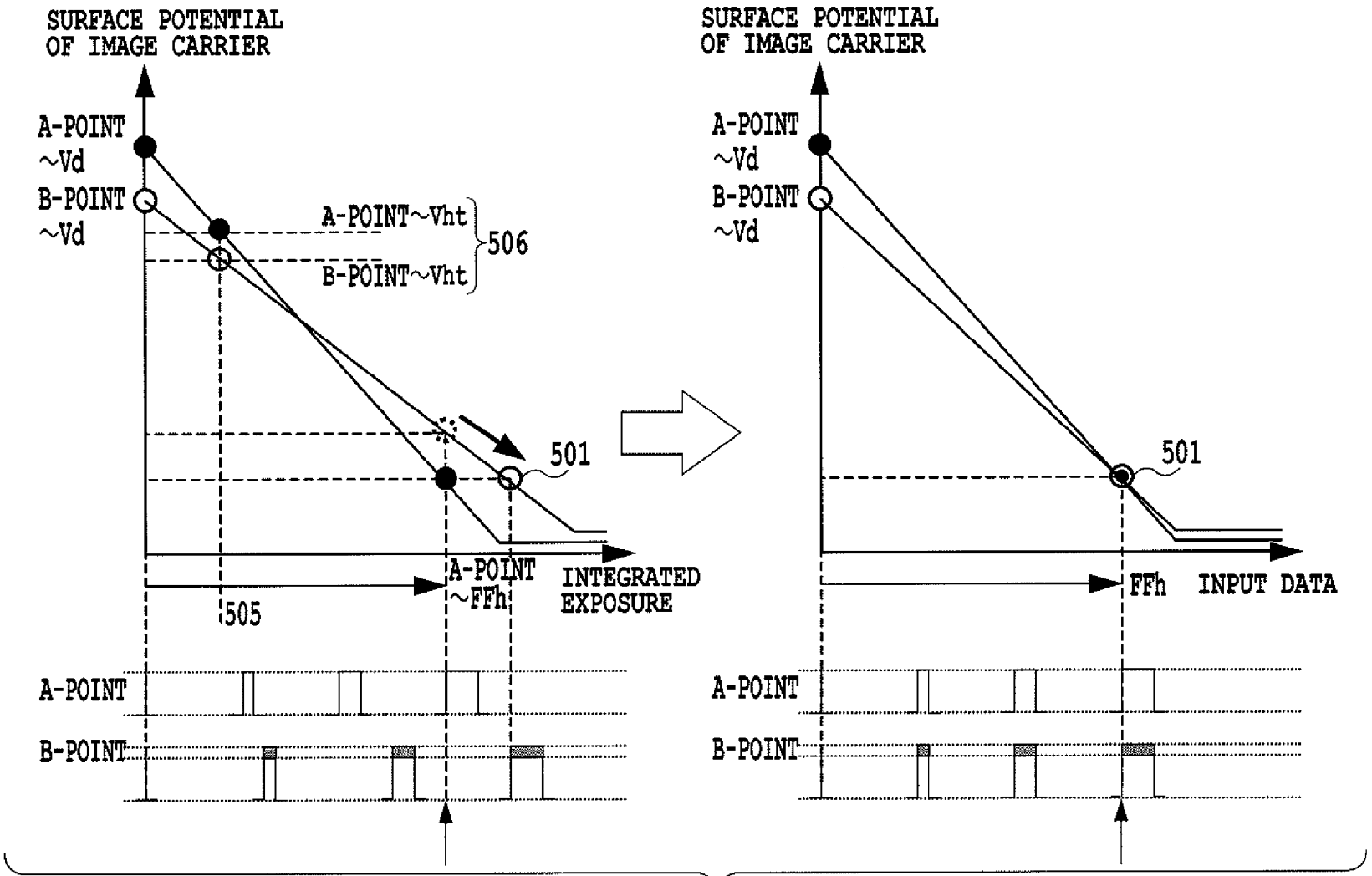
FIG. 5 is graphs for explaining a correction method which is an object of the present invention.

The measured on-surface potentials are sequentially stored in a RAM with the HP of the image carrier as a reference, as in the case of the correction of the charge potential. With regard to the calculation of correction coefficients, in a case where a V-E curve is linear with respect to integrated exposure as shown in FIG. 4 of this example, the measured charge potential and the measured exposure potential are connected by a straight line, the gradient thereof is determined on the assumption that the change therebetween is linear, and correction coefficients for the laser power are calculated from the obtained gradient and the potential difference which is desired to be corrected. In a case where the V-E curve of the image carrier is non-linear, it is more preferable to calculate appropriate correction coefficients using a translation table such as an LUT based on characteristics thereof.

Actual on-surface unevenness correction is realized by switching the power of the laser of the scanning optical system for every 10 mm along the main-scanning direction. In this example, measurement is performed at nine points with 40 mm pitch along the main-scanning direction of the laser scan, i.e., the longitudinal direction of the image carrier. Accordingly, linear interpolation is performed using these points, and correction coefficients for the laser power are obtained by the aforementioned method from the on-surface unevenness data with 10 mm pitch for 33 points, and stored in a line buffer memory (RAM).

In this example, since potential data is stored with 10 mm pitch along the sub-scanning direction, which is the rotation direction of the image carrier, correction is performed across a width of ±5 mm along the circumferential direction for each measurement position. On the other hand, for the main-scanning direction, correction coefficients for the main-scanning direction are sequentially calculated from the unevenness information stored in the RAM in accordance with the rotation of the image carrier, and stored in a line buffer memory, thus correcting the laser power.

A method of correcting the laser power will be described in detail using FIG. 13.

As described previously, the write start position along the main-scanning direction is controlled as follows: image clocks are counted up with the BD signal as a reference, and stored in a memory, thus obtaining address data for the main-scanning direction, and performing control. For the sub-scanning direction, which is the rotation direction of the image carrier, the HP of the image carrier is detected using the detection signal of the reflective sensor 807 or the like placed on a side surface or the like of the rotating image carrier. Then, with this detection signal as a reference, an address value is counted up every time a BD signal is obtained, thus obtaining address data for the sub-scanning direction. Based on this address data, for each position, a value obtained by multiplying the target voltage value to be applied to the laser by the correction coefficient is inputted from the sequence controller to an APC circuit for correcting the aforementioned laser power, thus controlling the laser power. FIG. 12B shows the change of the correction laser power at this time with tone.

In this example, different kinds of potential unevenness at A-point and B-point such as shown in FIG. 4 are dealt with as follows. Specifically, as shown in FIG. 11, in the correction of the charge potential, for portions in which the charge potential is higher than that of a reference position, the pulse width of the laser is adjusted by multiplying a correction coefficient obtained by converting the difference from the charge potential of the reference position.

For exposure potential unevenness, as described previously, exposure potential unevenness is measured in a state where charge potential unevenness is corrected, thus obtaining unevenness information. Based on this unevenness information, laser power control is sequentially performed to realize correction.

As described above, correcting charge potential unevenness by the offset correction of the laser pulse width and correcting exposure potential unevenness by laser power control have made it possible to perform correction with good consistency throughout the entire range of tones on the entire surface. Moreover, such on-surface unevenness correction can be performed anytime during the operation of the image forming apparatus. Furthermore, correction timing can be appropriately adjusted in consideration of the balance between a reduction in throughput and the stability of the output image density.

Figure 13:
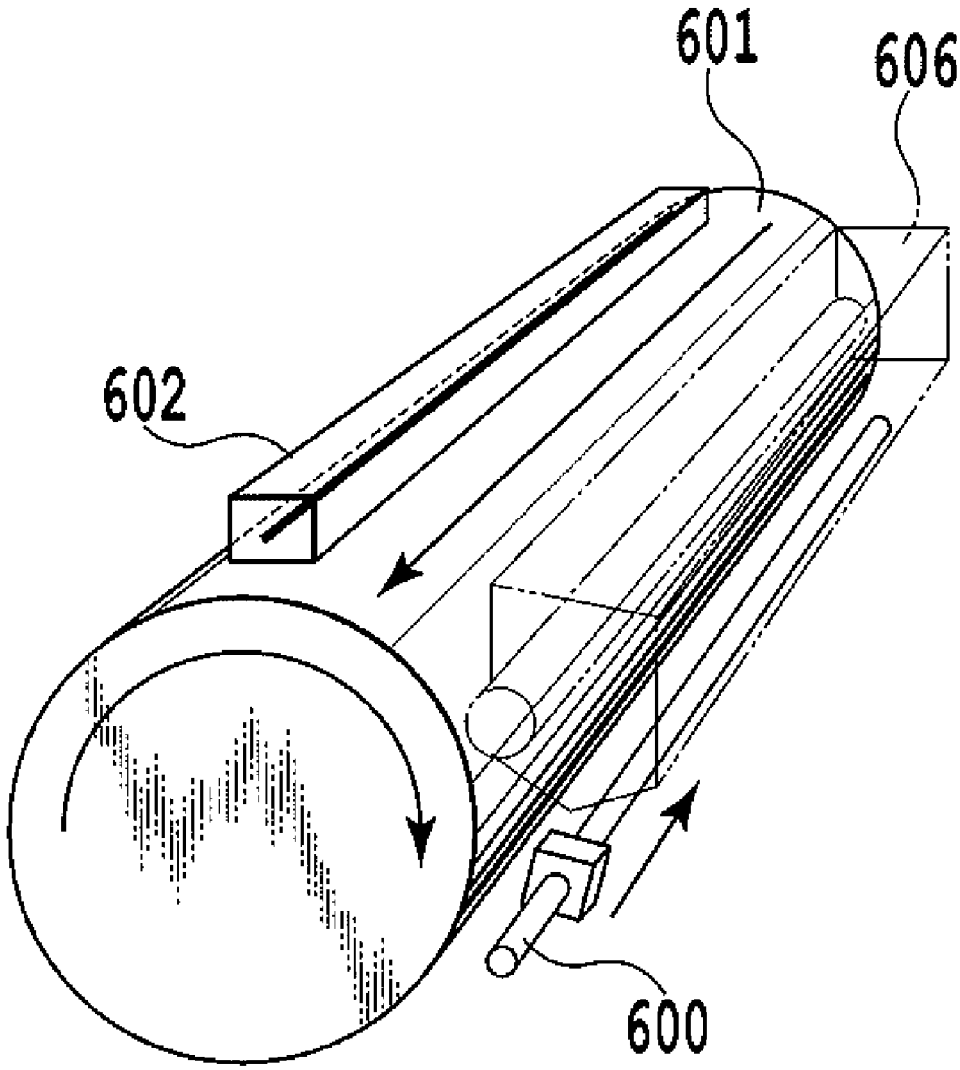
FIG. 13 is a schematic diagram showing a configuration for potential measurement of one embodiment.

In Example 2, as shown in FIG. 13, charge potential unevenness and exposure potential unevenness were measured using a movable potential sensor, and the charge potential and the exposure potential were corrected by a method similar to that of Example 1. In this example, by measuring the potentials in steps of 10 mm along the main-scanning direction to obtain unevenness information, unevenness information acquisition was realized with higher accuracy than in the linear interpolation method along the main-scanning direction, which was performed in Example 1. Thus, effects similar to those of Example 1 were realized.

Figure 14A:
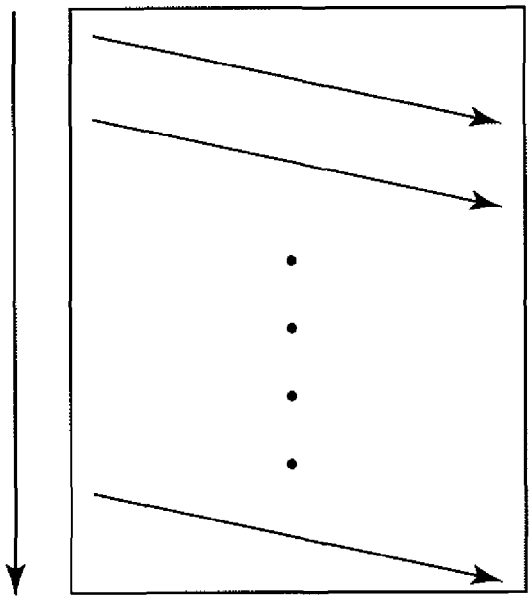
FIG. 14A is diagrams for explaining the correction method of one embodiment.
Figure 14B:
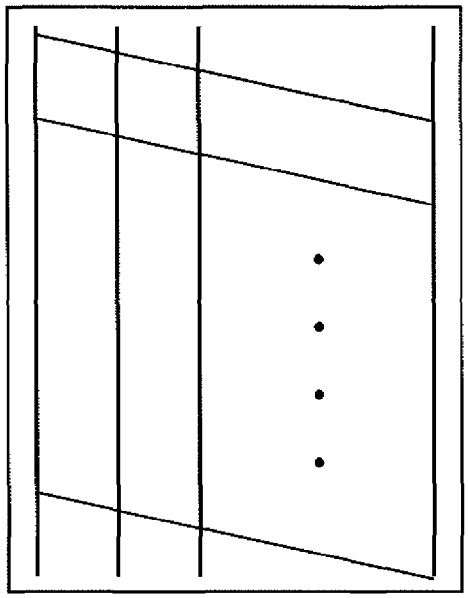
FIG. 14B is diagrams for explaining the correction method of one embodiment.

It should be noted that, in this example, unevenness information on the surface potential was obtained by scanning the movable potential sensor as shown in FIG. 14A. When correction is performed, position information is divided for each of areas delimited by oblique lines as shown in FIG. 14B to perform correction.

In Example 3, an amorphous silicon (a-Si) photoconductor is used for the image carrier. In a step before this is installed in the image forming apparatus, the charge potential unevenness and the exposure potential unevenness of the image carrier are separately measured outside the image forming apparatus. Then, unevenness information on the image carrier is held in the image forming apparatus in a form of storing the information in a ROM.

Figure 15:
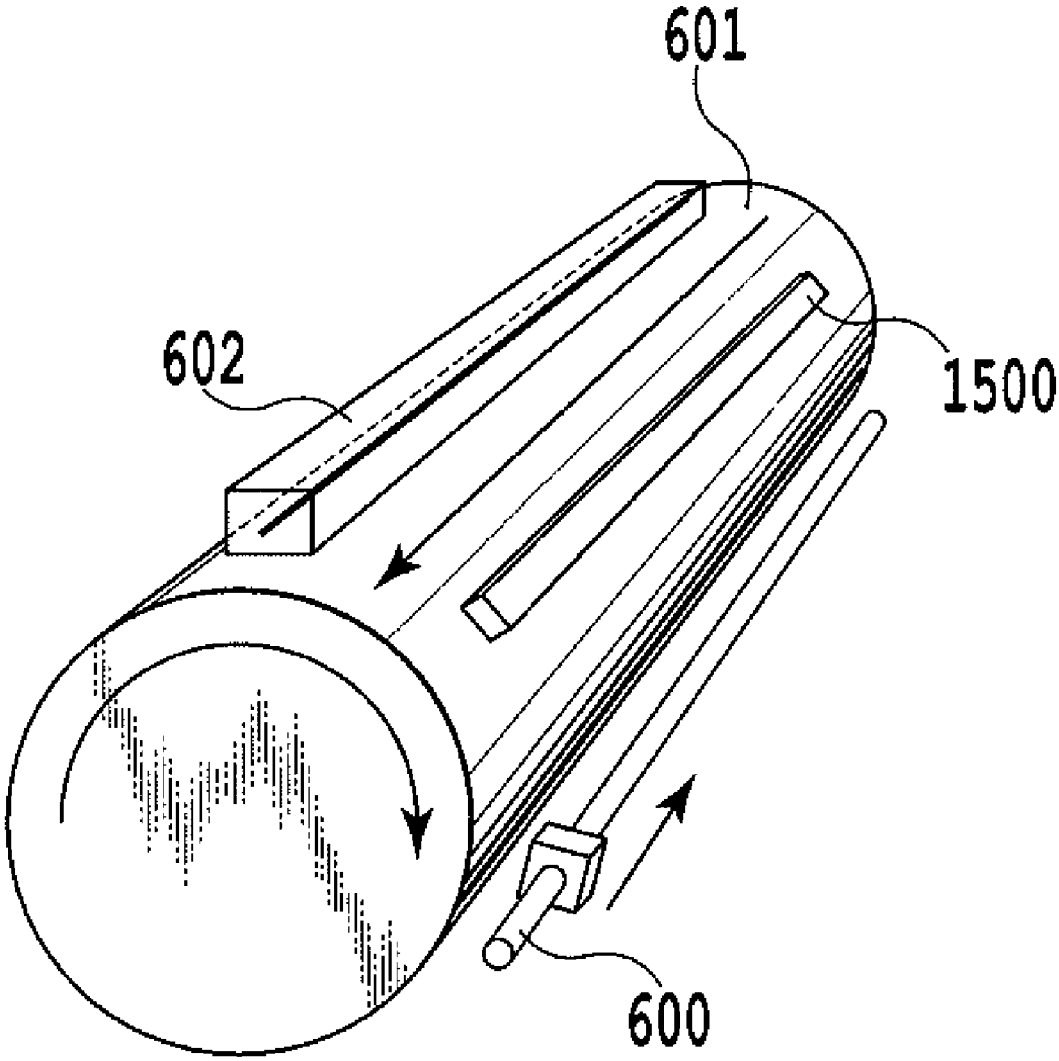
FIG. 15 is a schematic diagram showing a configuration of a potential measurement apparatus of one embodiment.

Specifically, as shown in FIG. 15, outside the image forming apparatus, by using a movable potential sensor 600, charge potential unevenness is measured at a charging position similar to that for actual image formation. Then, exposure is performed at an exposing position similar to that for actual image formation, thereby measuring exposure potential unevenness. In this example, for simplicity, a solid-state scanner 1500 was used for image exposure, and an image was exposed with a light quantity similar to that in the image forming apparatus, thereby measuring exposure potential unevenness.

Light quantity unevenness along the longitudinal direction of the solid-state scanner 1500 was corrected in advance by shading correction to enable image exposure which is uniform along the longitudinal direction. Furthermore, in this example, exposure unevenness was measured without correcting charge potential unevenness. With regard to unevenness caused when exposure was performed, it is assumed that the V-E curve, which represents the change of the surface potential of the image carrier relative to exposure, is linear as shown in FIG. 4, exposure potential unevenness was estimated based on the difference between the charge potential and the exposure potential. Potential measurement at this time is performed outside the apparatus, and therefore can be repeatedly performed. In this example, by obtaining potential unevenness from average values of the results of measurement for 10 revolutions, it has become possible to measure potential unevenness with higher accuracy. It should be noted that the measurement pitch for potential unevenness at this time was the same as that of Example 1.

Figure 16:
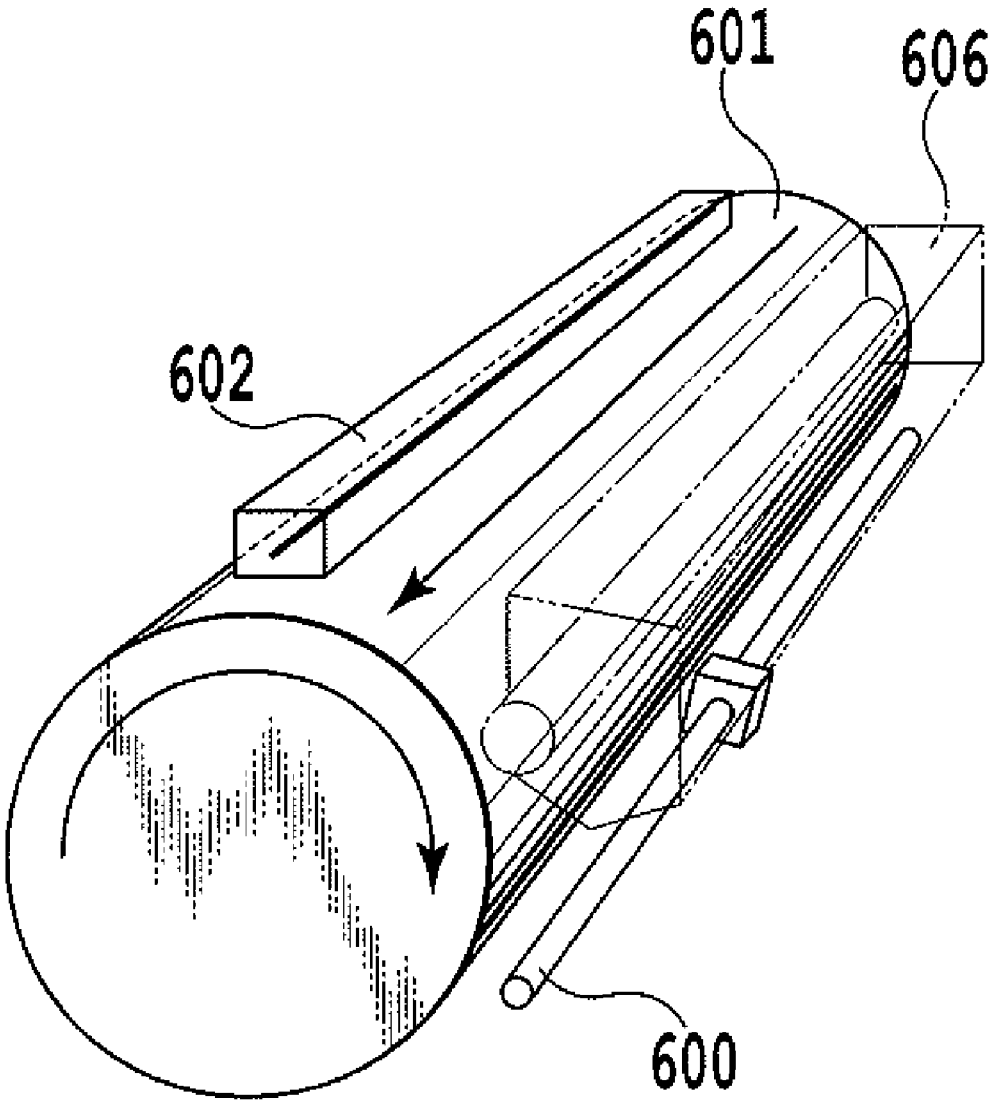
FIG. 16 is a schematic diagram showing a configuration for potential measurement of one embodiment.

Based on the obtained potential unevenness information, unevenness in the charge potential and the exposure potential is corrected by a method similar to that of Example 1. In this case, information is also needed with regard to the absolute value of the potential. Accordingly, as shown in FIG. 16, by using the potential sensor 600 fixedly placed in a longitudinal center portion of the image carrier, potential unevenness information along the circumferential direction is measured for the charge potential and the exposure potential. Based on the one-dimensional potential information obtained at this time, by using the average values thereof, correction was performed so that potential unevenness information measured in advance can be offset. As a result, effects similar to those of Example 1 were realized.

As in the case of this example, the use of the a-Si image carrier, in which the change of the film thickness is small throughout an image formation process, makes it possible to obtain favorable correction results for a long time by storing on-surface unevenness information on the image carrier before shipment and correcting the on-surface unevenness information.

Figure 17:
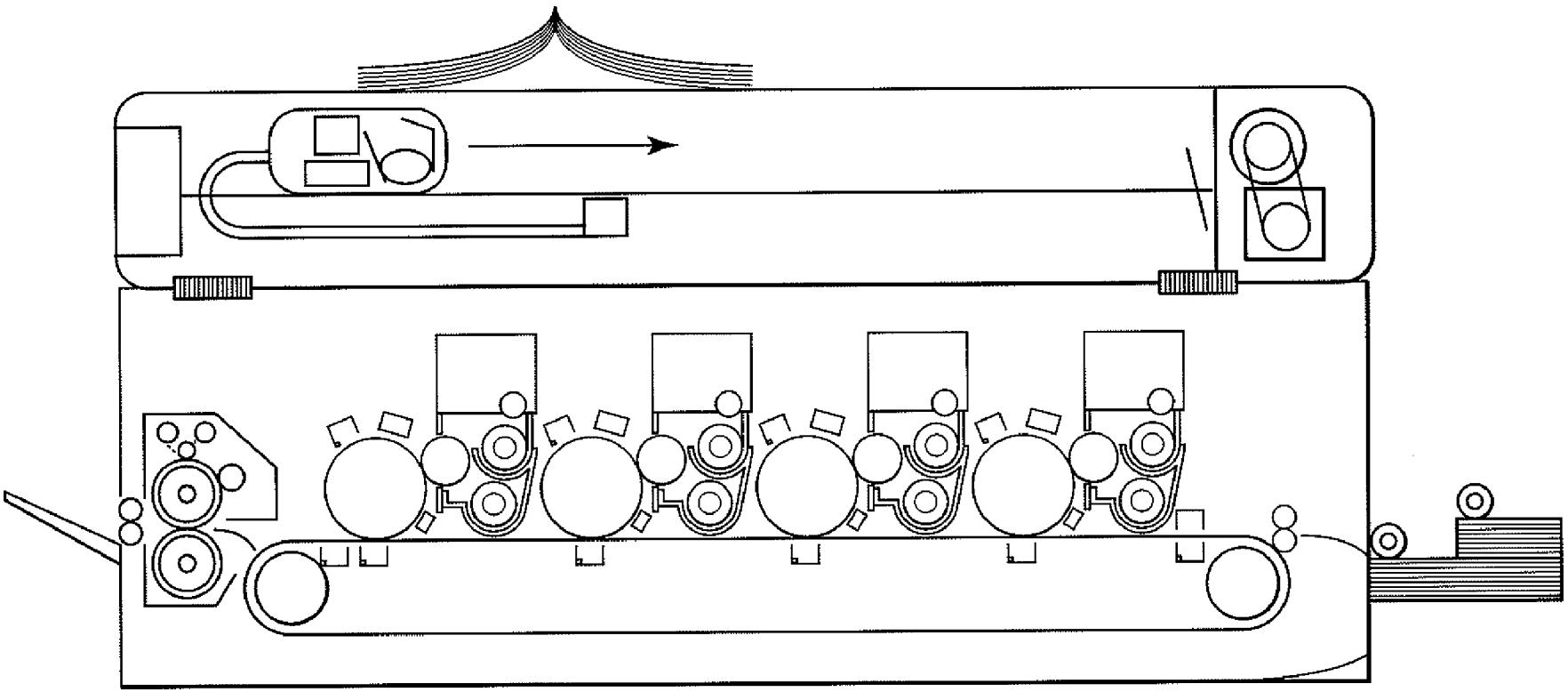
FIG. 17 is a schematic diagram showing a configuration of an image forming apparatus of one embodiment.

In Example 4, for a tandem type image forming apparatus having a plurality of image carriers such as shown in FIG. 17, exposure potential unevenness information was calculated from the result of measuring an image density. Specifically, entire surface images of intermediate tone densities were outputted, the two-dimensional density unevenness of the image of each color outputted at this time was measured, and values corresponding to the potential unevenness were calculated from the values of the density unevenness by using a potential-density translation table. By using the values corresponding to the potential unevenness, which are obtained from the density unevenness, and by correcting the exposure potential, each unevenness of the developing units can also be corrected, and favorable results can be obtained, even in the case where one developing unit is provided to one image carrier as shown in FIG. 17.

In this example, density unevenness was obtained by measuring the output images outside the image forming apparatus by using a calorimeter. However, of course, it is possible to use the result of detecting density unevenness for each color by using a density sensor in the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-005153, filed Jan. 12, 2006, which is hereby incorporated by reference herein in its entirety.

What is claimed is:

1. An image forming apparatus having a photoconductive image carrier; a charging unit configured to charge the image carrier; an exposing unit configured to expose an image on a surface of the image carrier after the charging to form a latent electrostatic image; a developing unit configured to develop the latent electrostatic image by adhering toner to the latent electrostatic image to form a toner image; and a transferring unit configured to transfer the obtained toner image to a final supporting member; the image forming apparatus comprising:

a storing unit configured to store positional unevenness information on each of (i) charge potential unevenness, which occurs when the charging at different positions of the surface of the image carrier is performed, and (ii) exposure potential unevenness, which occurs when the exposure at different positions of the surface of the image carrier is performed, wherein the exposing unit is configured to correct, for each position, the charge potential unevenness and the exposure potential unevenness by control the emission of light from the exposing unit by use of correction values calculated from the separately stored positional unevenness information.

2. The image forming apparatus as claimed in claim 1, further comprising a measuring unit configured to measure the potential unevenness information on each of (j) the charge potential unevenness and (ii) the exposure potential unevenness.

3. The image forming apparatus as claimed in claim 1, wherein said storing unit is configured to which store the positional unevenness information as information in a positional matrix formed by two-dimensionally dividing the surface of the image carrier.

4. The image forming apparatus as claimed in claim 1, wherein said storing unit is configured to store the positional unevenness information as unevenness information along each of a main-scanning direction and a sub-scanning direction on the surface of the image carrier, and wherein the unevenness information at each position on the surface of the image carrier is determined by calculation.

5. The image forming apparatus as claimed in claim 1, wherein potential measurement is performed by a measuring unit to measure the potential unevenness information.

6. The image forming apparatus as claimed in claim 1, wherein density measurement after toner adhesion is performed by a measuring unit to measure the positional unevenness information.

7. The image forming apparatus as claimed in claim 1, wherein the positional unevenness information is measured in the image forming apparatus, and the unevenness information stored in the storing unit means is regularly updated.

8. The image forming apparatus as claimed in claim 1, wherein amorphous silicon is used for the image carrier.

* * * * *